United States Patent [19]

Vargas

[11] Patent Number: 4,515,688

[45] Date of Patent: May 7, 1985

[54] PROCESS FOR THE SELECTIVE SEPARATION OF BASE METAL SULFIDES AND OXIDES CONTAINED IN AN ORE

[75] Inventor: Alfredo P. Vargas, La Paz, Bolivia

[73] Assignee: South American Placers, Inc., Peru

[21] Appl. No.: 476,611

[22] Filed: Mar. 18, 1983

Related U.S. Application Data

[63] Continuation-in-part of Ser. No. 410,127, Aug. 20, 1982, abandoned.

[51] Int. Cl.[3] ..... B03D 1/14

[52] U.S. Cl. ..... 209/167; 209/166

[58] Field of Search ..... 209/3, 4, 9, 5, 10, 209/12, 164, 165, 166, 167; 423/28, 29, 37, 53, 98, 109, 150; 75/2, 106

[56] References Cited

U.S. PATENT DOCUMENTS

| | | | |
|---|---|---|---|
| 1,429,544 | 9/1922 | Stevens . | |
| 1,469,042 | 9/1923 | Hellstrand | 209/167 |
| 1,833,957 | 12/1931 | Thomas et al. | 209/166 |
| 1,916,196 | 7/1933 | Ayer et al. . | |
| 2,048,370 | 7/1936 | Brinker | 209/167 |
| 2,052,214 | 8/1936 | Brinker | 209/167 |
| 2,195,724 | 4/1940 | Gaudin et al. . | |
| 2,196,233 | 4/1940 | Terry | 209/167 |
| 2,231,265 | 2/1941 | Gaudin | 209/167 |
| 2,316,743 | 4/1943 | Marsh . | |
| 2,471,384 | 5/1949 | Booth et al. . | |
| 3,033,364 | 5/1962 | Weston | 209/9 |
| 3,454,161 | 7/1969 | Mercade | 209/167 |
| 3,811,569 | 5/1974 | Shirley | 209/167 |
| 3,847,357 | 11/1974 | Weston . | |
| 3,919,080 | 11/1975 | Stauter | 209/167 |
| 4,081,364 | 3/1978 | Leptic | 209/167 |
| 4,211,642 | 7/1980 | Petrovich . | |
| 4,231,859 | 11/1980 | Huiatt et al. | 209/167 |

FOREIGN PATENT DOCUMENTS

| | | |
|---|---|---|
| 401720 | 11/1933 | United Kingdom . |
| 447521 | 5/1936 | United Kingdom . |
| 692623 | 10/1979 | U.S.S.R. . |

OTHER PUBLICATIONS

Nakahiro–Effect of Sodium Sulfide on the Prevention of Copper Activation for Sphalerite, M/M, Fac Engr Kyota Chivpart 4, 10/78, pp. 241–257.

Mitrofanov, Solution of Some Problems Concerning the Theory and Practice of Selective Rotation in the USSR, Int Mineral Dressing Congress, Stockholm, 1957, pp. 441–449.

*Primary Examiner*—Bernard Nozick

*Attorney, Agent, or Firm*—Darby & Darby

[57] ABSTRACT

The present invention comprises a process for the separation of ore components by flotation comprising: grinding ore to form pulp, mixing said pulp with sulfide ions and cyanide ions, adjusting the concentration of said sulfide ions to a level at least sufficient to cause depression of base metal mixed sulfides but insufficient to cause substantial activation of pyrites, and adjusting the concentration of said cyanide ions to a level at least sufficient to cause auxiliary depression of the mineral components of said ore which are required to be depressed in said flotation, but insufficient to cause over-depression of said mineral components; said sulfide ions and cyanide ions having been introduced to said pulp at predetermined times and in a predetermined sequence.

22 Claims, 3 Drawing Figures

PROCESS FOR THE SELECTIVE SEPARATION OF BASE METAL SULFIDES AND OXIDES CONTAINED IN AN ORE

This application is a continuation-in-part of my copending application Ser. No. 410,127 filed on Aug. 20, 1982 now abandoned.

FIELD OF THE INVENTION

The present invention relates to a process for ore beneficiation by flotation. More particularly, the present invention relates to the direct, i.e., straight, depression and selective flotation (hereinafter also referred to as "sequential flotation") of mixtures of base metal sulfides and/or partially oxidized sulfides (such mixtures being hereinafter referred to as "mixed sulfides") in the absence of pH modifiers, such as alkali and acids, which permits normal or better grades and recoveries to be obtained, without incurring the cost of base and acid additives. The applicability of the process of the present invention is not limited to base metal ore beneficiation, but extends also to treatment of other ores, including non-metallic ores and rocks such as coal, which contain base metal mixed sulfides as minor components.

BACKGROUND OF THE INVENTION

Most of the economically significant base metal ore deposits worldwide contain mixed sulfides. The conventional methods for beneficiation of such ores involve, initially, bulk flotation of metal sulfides and/or subsequent selective flotation of each metal sulfide, depending on individual ore characteristics. Oxidized sulfides are normally recovered separately from nonoxidized sulfides ("consecutive flotation"), since they are not readily floatable except after pretreatment with sulfidizers, to render their surfaces hydrophobic. After such pretreatment, the oxidized sulfides may also be recovered by flotation.

Conventional selective flotation of mineral sulfide particles requires grinding of the ore to liberation size, formation of an ore pulp, addition of appropriate depressors, activators, collectors and frothing agents and subsequent flotation in multiple stages.

Pyrites are some of the most common constituents of base metal ores. Their presence in flotation is undesirable because they are generally difficult to depress and normally require a relatively highly alkaline medium. Consequently, a great number of industrial scale flotation separations are performed at an alkaline pH obtained by addition of pH modifiers to the pulp, such as lime, soda ash etc. (hereinafter referred to as "alkaline flotation"). Unfortunately, alkaline flotation results in consumption of substantial quantities of such modifiers, and often in consumption of corresponding amounts of pH neutralizers downstream. In addition, high alkalinity often causes overdepression of other valuable components and decreases the efficiency and selectivity of the separation, requiring larger amounts of activators and collectors, and resulting in increased processing costs.

As a result of the widespread use of highly alkaline flotation media, the flotation behavior of sulfides in such media has been the subject of extensive study which has generated voluminous literature directed to both the theoretical and practical aspects of such flotation. For an overview of the research published on this topic, see Leja, J. (1982), *Surface Chemistry of Froth Flotation,* pp. 642–659, Plenum Press, New York; and Staff (1982), *Flotation Review,* Mining Engr., Vol. 34, Nos. 3, 4, pp. 275–279, 377–381. However, comparatively little investigation has been devoted to sulfide flotation in the absence of pH modifiers, i.e., at a natural (unmodified) pH determined mainly by the particular ore composition and the quality of the water supply available.

Soluble cyanides (such as sodium and potassium) and soluble sulfides such as sodium sulfide, hydrogen sulfide, polysulfides, etc., are commonly used in alkaline flotation as follows: cyanides are used as complexing and depressing agents; soluble sulfides are used (a) as sulfidizers for oxides and oxidized sulfides (in "consecutive" flotation of oxides); (b) as sulfide depressants (after bulk flotation and/or prior to selective flotation); and (c) as collector desorbents subsequent to the collection of a floated fraction. If $Na_2S$ is used, the quantity required for all of the above uses is of the order of 1,000 g/ton of ore or more.

Dilute solutions of sodium sulfide (i.e., of the order of 0.1M) have been used historically by investigators to pretreat mineral surfaces preparatory to microflotation studies, in order to displace elemental sulfur and other surface oxidation products from sulfide minerals and thereby carefully control experimental conditions, as is necessary in basic research. Such surfaces are thoroughly washed, however, prior to actually carrying out the microflotation tests.

One such basic research study was conducted by Y. Nakahiro: *Effect of Sodium Sulfide on the Prevention of Copper Activation for Sphalerite,* Mem. Fac. Engr. Kyoto Univ., Part 4, Oct. 1978; pp. 241–257. It involved only the investigation of the effect of sodium sulfide and/or sodium cyanide specifically on the copper activation of sphalerite. The sample tested involved extremely pure copper/zinc sulfide from high grade samples further treated to eliminate quartz, galena, pyrite and other impurities. The results indicated that, in that carefully controlled sample and system, small amounts of $Na_2S$ had a depressant effect on sphalerite, which was enhanced by the copper ion complexing action of NaCN. However, this effect was pH dependent, the author recommending separation of copper from zinc at an alkaline pH above 8.1. Thus, Nakahiro's study was of limited scope and applicability and its results spoke in favor of pH modification to improve selective flotation.

U.S. Pat. No. 1,469,042 to Hellstrand, issued on Sept. 25, 1923, is directed to a process of bulk (not selective) flotation of a lead-iron (or lead-iron-copper) concentrate using 1–7 lbs of $Na_2s$ per ton of mill feed during the wet-grinding stage to accelerate flotation of (i.e., activate, not depress) the constituents of said concentrate and inhibit that of zinc. Therefore, this is not a process of true selective flotation, which involves flotation of one metalliferous constituent at a time and removal thereof before flotation of another metalliferous constituent. In addition, amounts of $Na_2S$ used are much higher than in the process of the present invention, and Hellstrand's process is not applied to oxidized sulfides (non-simultaneous, i.e., sequential flotation), the term "flotation of mixed sulfides", as used in this patent, meaning simply flotation of sulfides of several metals, i.e., what is today known in the industry as a bulk concentrate.

U.S. Pat. No. 1,916,196 to Ayer, issued on July, 4, 1933, is directed to a process for simultaneous flotation of mixed copper sulfides (sulfides, oxidized sulfides, and carbonates) using soluble sulfides, such as $Na_2S$, as conditioning additives together with other sulfidizing agents at a carefully controlled pH range between 4.8 and 6.5, the objectives being enhancement of sulfidization, precipitation of copper ions from solution and recovery thereof as sulfides, and bulk flotation of all metalliferous mineral particles.

A method was sought which would decrease the cost and/or increase the efficiency of selective base metal ore flotation, particularly one which avoids the need for making a large capital expenditure, such as building of new facilities or extensive modification of existing ones. Accordingly, a method was sought which would decrease the number of flotation stages, reduce reagent consumption, and increase flotation selectivity.

OBJECTS OF THE INVENTION

One object of the present invention is to provide a process for ore enrichment by flotation conducted at an unmodified pH, thereby making it possible to eliminate the use of pH modifiers such as lime and acids.

Another object of the present invention is to provide a process for the depression and selective sequential flotation of base metal mixed sulfides conducted at natural (i.e., unmodified) pH values.

Another object of the present invention is to provide a process for the efficient recovery of the mixed sulfides of the individual metals at reduced costs of processing, reagents and equipment, without sacrificing process selectivity or product grades and recoveries.

A further object of the present invention is to provide a process for the recovery of base metal mixed sulfides by selective sequential flotation conducted in the absence of pH modifiers (alkaline or acid) but using otherwise conventional types of reagents (collectors, frothers, depressants, activators, etc.) and existing plant facilities and equipment.

These and other objects of the present invention will be apparent to one skilled in the art in light of the following description, accompanying drawing, and appended claims.

SUMMARY OF THE INVENTION

The present invention comprises a process for the separation of ore components by flotation comprising: grinding ore to form pulp, mixing said pulp with sulfide ions and cyanide ions, adjusting the concentration of said sulfide ions to a level at least sufficient to cause depression of base metal mixed sulfides but insufficient to cause substantial activation of pyrites, and adjusting the concentration of said cyanide ions to a level at least sufficient to cause auxiliary depression of the mineral components of said ore which are required to be depressed in said flotation, but insufficient to cause overdepression of said mineral components; said sulfide ions and cyanide ions having been introduced into the pulp at predetermined times and in a predetermined sequence.

DETAILED DESCRIPTION OF THE INVENTION

Figure 1:
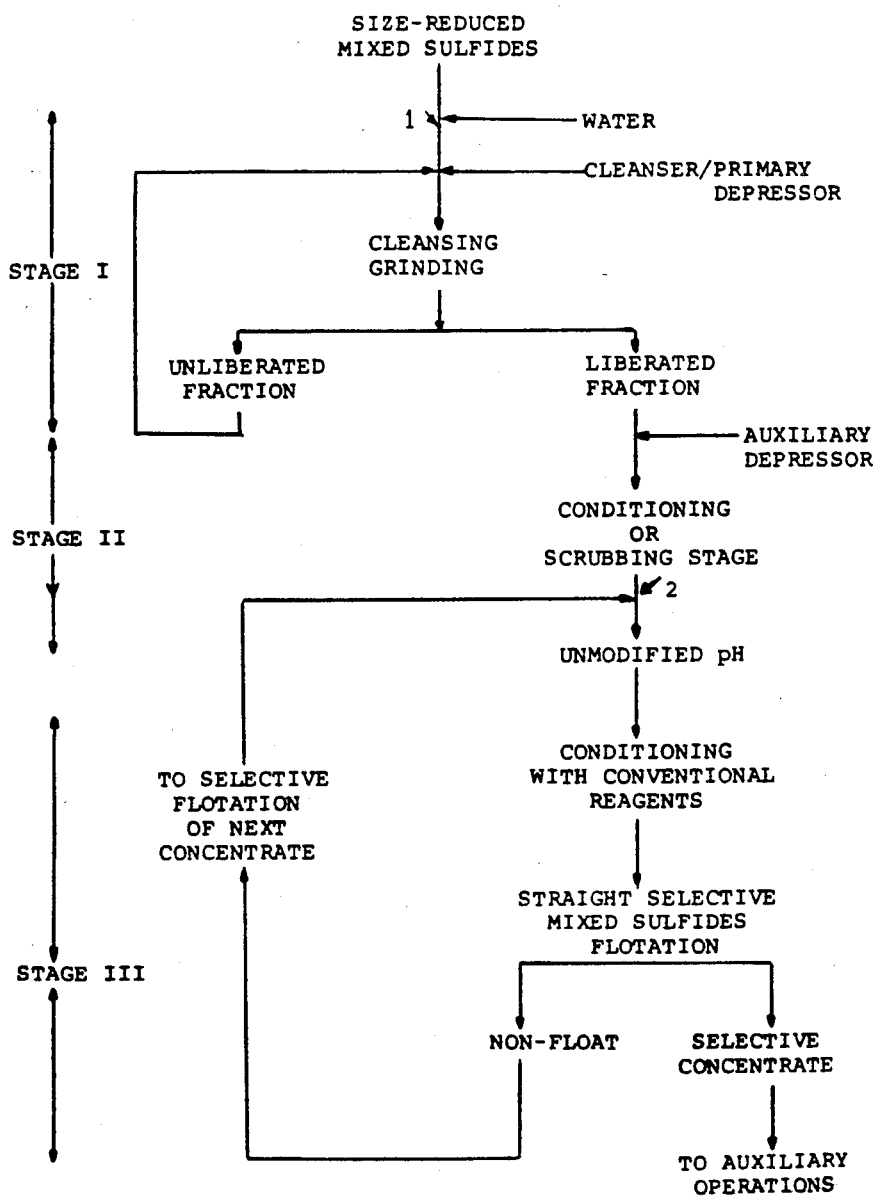

The present invention is described in detail in connection with the preferred embodiments and particularly in connection with FIG. 1, which is a schematic flowsheet of a base metal mixed sulfide flotation process, and FIGS. 2 and 3, which are schematic flowsheets of Mo-Cu sulfide flotation processes.

A complex base metal ore, comprising mixed sulfides, gangue materials, etc., is subjected to conventional coarse-size reduction (crushing) and, subsequently, to fine-size reduction (wet-grinding) to reduce the particles of the valuable metalliferous components to liberation size. This wet-grinding stage may be conducted in one or more stages using conventional equipment (rod, ball or autogeneous mills) to create "ore pulp". Preflotation conditioning according to the present invention may begin as early as the wet-grinding stage, or even slightly before wet-grinding, and may end as late as immediately prior to the first flotation step in the sequence. In FIG. 1, preflotation conditioning can encompass stages I and II, and more specifically it may include the portion of the FIG. 1 diagram from point 1 to point 2.

One aspect of such preflotation conditioning involves addition of a small amount of sulfide ions (cleanser/primary depressor) to the ore, preferably during the wet-grinding stage, to achieve better mixing and surface contact and most preferably before any other additives are introduced in the pulp. However, addition of a water-insoluble collector at this wet-grinding stage, which is often desirable to reduce overall collector consumption, does not normally affect the sulfide ion action.

Another aspect of preflotation conditioning according to the present invention involves addition of a small amount of cyanide ion in the pulp during preflotation conditioning. Cyanide ion is preferably added after wet-grinding.

It is to be noted generally in this discussion that the particular amounts of sulfide and cyanide used in accordance with the present process, as well as the timing and sequence of their introduction, are determined separately for each case because they depend on the particular characteristics (metal and non-metal constituents) of each ore and the quality (mineral content and temperature) of the water employed in its treatment. Thus, for most base metal sulfide ores, sulfide ion is preferably added first, during wet-grinding, followed by cyanide during the remainder of preflotation conditioning. However, cyanide may also be added either simultaneously with the sulfide, or immediately after the end of wet-grinding, or even before addition of the sulfide or in multiple stages.

Accordingly, prior to large scale application of the present process to a particular ore, laboratory batch flotation studies should be conducted. These tests may be carried out by first trying concentrations of sulfide and cyanide based on concentrations that previous experience has shown to be suitable for similar ores, or, if there is no previous experience, based on the general ranges disclosed herein, varying said concentrations, until a trend is established, and following that trend until a concentration or a concentration range is found that produces optimum results, such as flotation selectivity, increased recovery etc.

Suitable sulfide or cyanide ion sources include any reagent which releases sulfide or cyanide ion into an aqueous solution, directly or pursuant to a reaction in the process conditions. Sodium sulfide and sodium hydrosulfide are preferred, with $Na_2S$ being most preferred. Of the soluble cyanides, sodium cyanide and potassium cyanide are preferred with NaCN being most preferred.

Addition of sulfide ion, which in FIG. 1 takes place during STAGE I, effects a cleansing of the ore particles during grinding which serves to selectively deoxidize mixed sulfide particle surfaces and to prevent oxidation of freshly exposed surfaces. This facilitates floatability of the mixed sulfide particles during later stages. The ability of sulfide ion to act as a primary depressant of sulfides, which is the second reason for its addition, is also enhanced by its addition during this preflotation conditioning treatment.

Cyanide ion action is considered to complement sulfide ion action and to enhance selective auxiliary depression of the desired minerals. In addition, cyanide ion serves to complex metal ions in solution.

As stated above, the amount of sulfide ion required to obtain both a surface cleansing effect and a primary mixed sulfide depression effect in base metal sulfides depends mostly on ore characteristics (as well as on water quality). If sodium sulfide is used as the source of sulfide ion, the amount required usually ranges between about 20 and 200 g/ton for most base metal sulfide ores. Too small an amount of sulfide ion will be ineffective as a depressant (a smaller amount would be also ineffective as a surface cleanser) and too large an amount will cause premature activation of certain sulfides, notably pyrite and in some cases copper, which is generally undesirable in selective flotation processes, in addition to being economically unattractive. As previously mentioned the sulfide ion quantity for each particular application is subject to optimization, which may be indicated by batch flotation testing. It is most preferable to operate a process using the minimum amount of sulfide ion that will produce the desired results (usually between about 20 and 50 g/ton if $Na_2S$ is used), as use of larger amounts is not only unnecessary (and costly) but it may actually be deleterious to the effectiveness of the present process, by causing a reversal of the depression effect, as discussed above.

From the wet grinding stage, the liberated pulp fraction is subjected to a conditioning stage comprising the second portion of preflotation conditioning and labelled "STAGE II" in FIG. 1. Therein, the pulp is conditioned with cyanide ion, preferably NaCN, which serves as an auxiliary depressor, mainly for pyrite, without overdepressing other minerals. Sodium cyanide consumption requirements usually range between about 20 and 200 g/ton, again depending on ore characteristics and process conditions, as was the case with the $Na_2S$ consumption requirements. Preferred NaCN consumption ranges from about 25 to 100 g/ton. For extremely slimy ore, the addition of a dispersing agent such as sodium silicate with the cyanide can be beneficial.

Pulp from STAGE II is further conditioned with collectors and frothers in accordance with usual practice for modern selective flotation in STAGE III. Selective flotation of base metal mixed sulfides in accordance with the present invention begins directly without a bulk flotation step.

Figure 2:
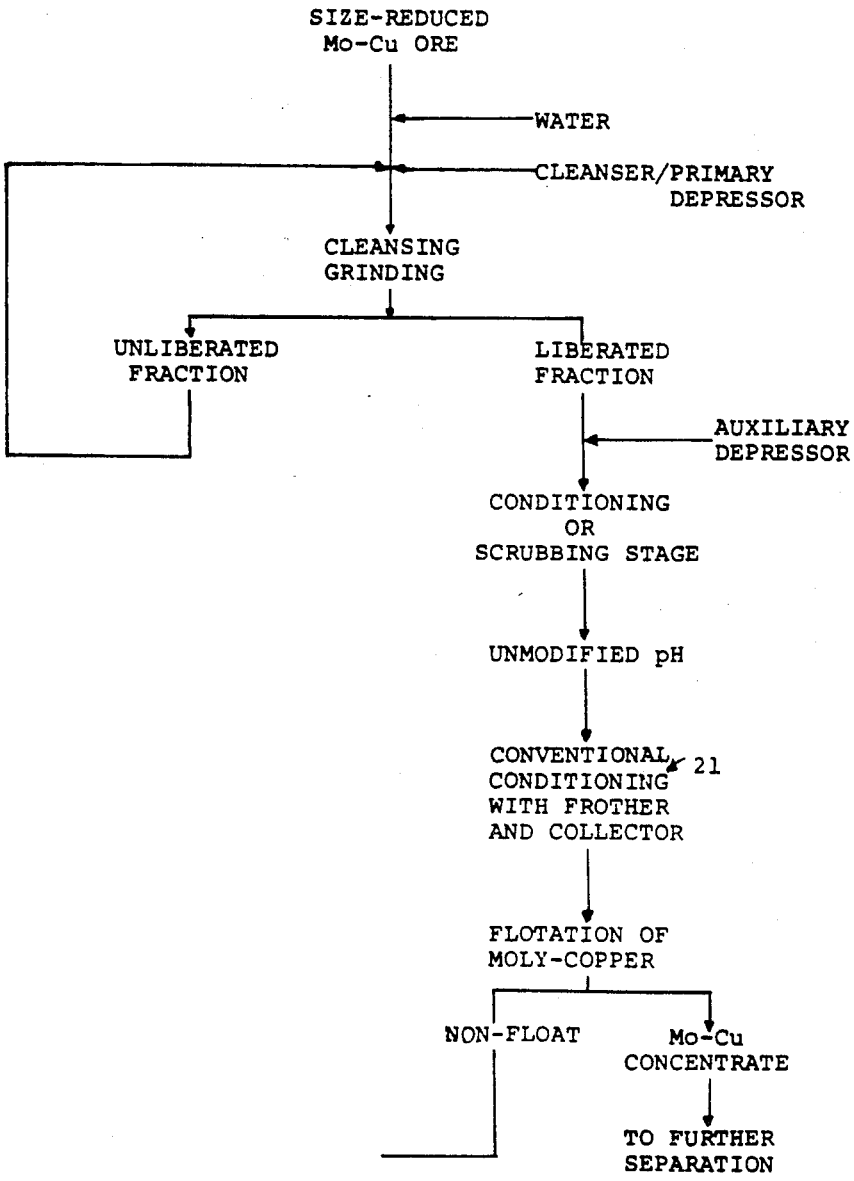
Figure 3:
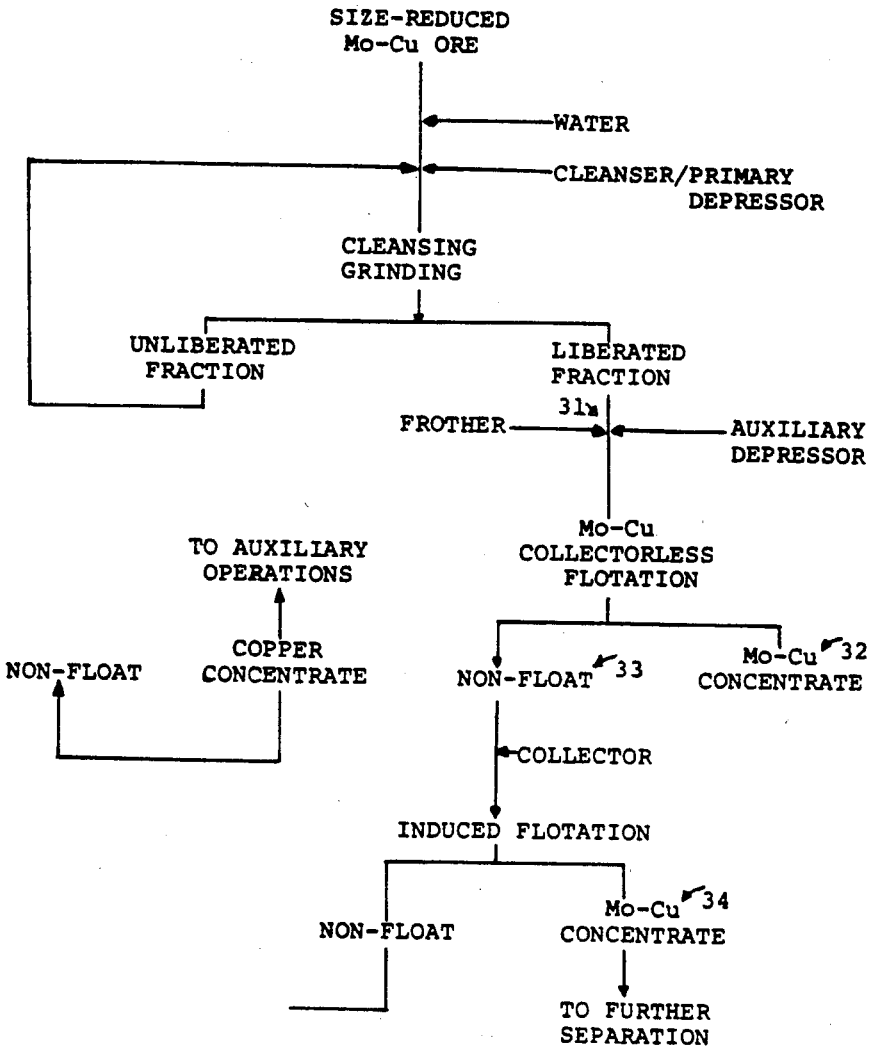

Thus, the present process is a process of truly sequential (selective) flotation. Depending on ore composition, such selective flotation is conducted in the following order removed first from left to right:

Pb-[Ag]:Cu:Zn:Fe in accordance with the scheme of FIG. 1 or:

Mo:Cu:Fe in accordance with the schemes of FIGS. 2 and 3: each metalliferous constituent is activated with an appropriate quantity of a specific activator and/or floated after addition of an appropriate quantity of a specific collector (and frother). The process is repeated until a non-float is obtained which, if desired, can be essentially sulfide-free. It is found that by use of the present invention, lower amounts of activators, collectors and frothers are necessary for flotation, as compared to flotation processes of the prior art.

If zinc is present in the complex mixed sulfide ore, it must be activated with, e.g., $CuSO_4$ prior to flotation. If both zinc and copper are present, the zinc sulfide is likely to be coated with copper ions which would ordinarily render differential flotation of copper from zinc difficult. However, the process of the present invention also solves this problem by complexing and/or desorbing the copper ions from the zinc sulfide surface.

The depression effect to the sulfide/cyanide ion combination is transient. Once a metal constituent has been floated and removed, the next one in the sequence can be floated easily using the conventional flotation scheme. The transience of sulfide ion action makes it desirable to control the timing of the sulfide ion introduction as well as that of the cyanide ion. However, as mentioned before, this can only be accomplished on a case-by-case basis.

The present invention permits one or more of the following major benefits to be obtained.

(1) Reduction of reagent costs due to pH modifier elimination, use of a relatively small amount of sulfide and cyanide ions, and/or use of reduced amounts of collectors, activators and frothers.

(2) Improvement in flotation selectivity. This permits reduction of operating and equipment costs and further reduction of reagent costs.

(3) Improvement in recovery over conventional methods.

(4) Improvement in concentrate grades obtained.

(5) Reduction in residence times for conditioning and flotation.

(6) Reduction or elimination of deleterious effects which high consumption of flotation reagents may have on further separation of other minerals (e.g. the presence of Ca ions is known to affect the subsequent flotation of cassiterite).

In addition, the present invention makes it possible to increase recovery of extremely fine mixed sulfide particles (slimes) which are normally lost in conventional processes.

The present invention, makes it unnecessary and in fact undesirable to add a pH modifier, such as lime, to the pulp. Lime has been customarily added in the wet-grinding stage of base metal ores. It has been found that addition of lime (increasing the pH) actually inhibits optimization of certain steps such as zinc activation. Without the lime, it is possible to operate at the pH range at which copper ion adsorption on zinc mineral particles is at a maximum.

These optimization considerations aside, it is generally possible to operate the present process and to obtain its major cost-saving benefits at a pH naturally ranging from about 5.5 to about 8.5. The unmodified pH of a flotation system may vary because of ore composition and local water quality. The important factor here is that pH need not be closely controlled or even monitored, and thus the present process is relatively pH-independent.

The present process is applicable to a variety of base metal mixed sulfide ores including, but not limited to, zinc, lead-zinc, lead-zinc-silver, lead-zinc-copper, copper-zinc, and copper-molybdenum. It is also applicable to other ores or rocks such as coal which contain sulfides as minor constituents.

In particular, the present process makes it possible to separate molybdenum from copper by straight selective flotation of a molybdenite-rich Cu-Mo concentrate and subsequent flotation of the remaining copper minerals.

As is well-known, Cu-Mo combined concentrate is normally floated in one step in primary flotation and is subsequently sent to another plant for further separation. The standard procedure for such separation is to depress the copper and float the molybdenum. Commonly used depressants in this secondary flotation circuit include any one or combinations of: NaHS, $Fe(CN)_2$, NaCN, Nokes' reagent ($P_2S_5$ in NaOH) and arsenic Nokes ($As_2O_3$ in $Na_2S$). Consumptions of such depressants are generally very high, ranging from about 10 to about 50 kg/ton.

Unfortunately, the agents which degrees copper also tend to depress molybdenum. Consequently, the Cu-Mo separation requires a relatively large number of stages. Another difficulty stems from the fact that the Cu-Mo concentrate, which becomes the feed in the Cu-Mo separation circuit, is contaminated with collector from the primary circuit, which inhibits later copper depression and necessitates use of large amounts of copper depressants.

In order to increase depressant effectiveness and curb secondary circuit reagent consumption, a number of stratagems have been employed to change the surface energy of the copper mineral particles by removing or rendering innocuous the collector coating using procedures such as steaming, roasting or aging of the pulp.

It has further been found that use of the present invention in connection with molybdenum containing ores not only affords the benefits enumerated above, and more or less common to all primary flotation circuits, but also makes possible flotation of a Cu-Mo concentrate which is (a) much lower in copper content, and (b) free of a copper collector. This means that the secondary separation (a) will be simplified requiring a smaller number of cleaner stages (and/or resulting in better concentrate grades and recoveries), and (b) will become substantially more cost effective requiring lower (both overall and per-stage) reagent amounts and smaller scale processing equipment.

Thus, when the present invention is used, in the pretreatment of a Cu-Mo containing ore, a choice of procedures is available at the copper flotation step as outlined in FIGS. 2 and 3.

(1) A collector may be added subsequent to use of the present invention, at point 21 in FIG. 2, to obtain flotation of a substantial volume of a Cu-Mo concentrate following the universal current practice. This procedure will afford one or more of the benefits previously enumerated above. The thus obtained Cu-Mo concentrate will contain most of the Mo and a substantial portion of the Cu (as much as about 90% of the copper and moly contained in the feed), but it will have a very low Mo grade. The concentrate will have to be sent to a conventional Cu-Mo separation plant for further separation.

(2) Alternatively, with specific reference to FIG. 3, the copper collector may be omitted, in which case a much lower volume of a Cu-Mo concentrate will be naturally floated, requiring the simple addition of a frother, 31, which may be added substantially simultaneously with the cyanide ion, or at any time thereafter prior to flotation, 32. The recovery of moly may be the same as in (1), but even if it is lower, the molybdenum grade of the concentrate will be substantially higher (as much as ten times that of (1), above) and the concentrate volume will remain substantially lower than in (1). This concentrate will also need to be sent to a separate plant for further processing but such further processing may be undertaken directly (without collector removal) and will require fewer stages, smaller scale processing equipment, and substantially smaller amounts of Cu-Mo separation depressants.

With continuing reference to FIG. 3, Non-float, 33, which still contains recoverable amounts of Mo is conditioned in accordance with conventional practice with a collector. A further Mo-Cu concentrate, 34, is thus obtained which may be subjected to conventional separation processes.

Thus, use of the present invention in connection with concentration of a Cu-Mo containing ore, affords added advantages, over processes of the prior art (insofar as the first Mo-Cu concentrate, 32, is concerned).

It has been determined in practice that the sulfide ion amount required for primary flotation of a typical Cu-Mo ore in accordance with the present invention varies with the particular ore composition and water quality. If $Na_2S$ is used as the source of the sulfide ions, the amount required usually ranges between about 5 and 30 g/ton, i.e., it is much lower than that generally required for concentration of other base metal mixed sulfide ores such as Pb-Zn. Moreover, the same sulfide ion is used to reactivate the copper minerals after the Mo float is removed. The consumption of cyanide ion is generally the same as in pretreatment of other sulfide ores.

Regarding the sequence and timing of sulfide/cyanide introduction, in Cu-Mo containing ores, it is possible to state generally that introduction of the cyanide preferably follows that of sulfide and involves a distinct step in the process.

Another economically advantageous application of the present invention is in coal flotation. Coal is often contaminated by sulfides which are sometimes removed by floating the coal in a conventional process using alkaline flotation. The present invention makes it possible to eliminate alkaline flotation, depress the mixed sulfides, and float coal inexpensively and with high selectivity.

EXAMPLES

The present invention and its technical and economic advantages are further illustrated by the following examples. These examples in no way limit the scope of the present invention.

The laboratory tests were conducted using 1–10 kg portions of different ore samples and standard laboratory facilities, and following the general procedures described above (STAGES I–III).

Tests were run at various locations to test performance of the present invention for a variety of ores and under a variety of local conditions, such as water quality.

The pH values obtained during different stages have been recorded. There has been no attempt to change or modify the pH. The values obtained are solely due to ore composition and water characteristics, the effects of any reagents or additives being minimal, due to the low quantities thereof.

The pH values obtained in the tests described below ranged between 5.5 and 8.5, showing that (contrary to the generally accepted thinking and practice) operability of the process is not particularly sensitive to pH changes over a substantial range. Results were generally more favorable at the lower pH end of the above range.

The following examples demonstrate that by use of the present invention low cost flotation recovery of mixed sulfide ores, as well as unoxidized sulfide ores, to yield commercial concentrates is possible. The data reproduced below are representative of the tests conducted, including initial tests, and have not been screened. Consequently, some of the final values which are less satisfactory than others are due to parameters independent of the invention, such as lack of experience of the operators.

ORE A-Sample from high-grade oxidized dumps containing about 35% pyrite, 25% argentiferous galena, 15% sphalerite and 25% quartzite gangue. (Villazon-Mojo Area, Potosi, Bolivia).

The following tests represent research performed to obtain separate lead-silver and zinc concentrates, from several oxidized dumps considered as potential feed for a custom mill project.

The excessive oxidation of the dumps material and the large amount of lime which would have been required to depress pyrite, made the ore difficult to treat and its exploitation non-profitable, prior to use of the present invention.

The testing results with comminution to 80% passing 150 mesh are summarized in Table 1, below and show high flotation selectivity and recoveries for all components (Zn contained in the Pb-Ag rougher concentrate is recycled into the flotation circuit):

TABLE 1

| TEST | REAGENTS (g/ton) | | | | | | | |
|---|---|---|---|---|---|---|---|---|
| No. | $Na_2S$ | NaCN | $Na_2SiO_3$ | A-242[1] | $CuSO_4$ | Z-11[2] | A-77[3] | pH |
| 1 | 200 | 150 | 100 | 75 | 300 | 50 | 25 | 6.5 |
| 2 | 150 | 200 | 100 | 75 | 300 | 50 | 25 | 6.3 |
| 3 | 100 | 250 | 100 | 75 | 300 | 50 | 25 | 6.2 |

| | | | LEAD | | SILVER | | ZINC | |
|---|---|---|---|---|---|---|---|---|
| No. | PRODUCTS | % WT | % | Dist. % | Oz/t | Dist. % | % | Dist. % |
| 1 | Pb—Ag Ro CONC. | 30.69 | 60.20 | 95.65 | 47.77 | 94.60 | 11.27 | 41.31 |
| | Zn Ro CONC. | 15.32 | 2.45 | 1.95 | 3.10 | 3.08 | 31.23 | 57.14 |
| | Non-Float | 53.99 | 0.86 | 2.40 | 0.67 | 2.32 | 0.24 | 1.55 |
| | Feed | 100.00 | 19.32 | 100.00 | 15.50 | 100.00 | 8.37 | 100.00 |
| 2 | Pb—Ag Ro CONC. | 33.12 | 62.21 | 95.76 | 46.93 | 94.67 | 8.02 | 29.94 |
| | Zn Ro CONC. | 23.88 | 2.60 | 2.88 | 3.07 | 4.46 | 25.55 | 68.75 |
| | Non-Float | 43.00 | 0.68 | 1.36 | 0.33 | 0.87 | 0.27 | 1.31 |
| | Feed | 100.00 | 21.52 | 100.00 | 16.42 | 100.00 | 8.87 | 100.00 |
| 3 | Pb—Ag Ro CONC. | 31.44 | 65.84 | 94.71 | 55.37 | 94.39 | 5.72 | 20.34 |
| | Zn Ro CONC. | 21.56 | 3.34 | 3.29 | 3.93 | 4.59 | 32.23 | 78.54 |
| | Non-Float | 47.00 | 0.93 | 2.00 | 0.40 | 1.02 | 0.21 | 1.12 |
| | Feed | 100.00 | 21.86 | 100.00 | 18.44 | 100.00 | 8.85 | 100.00 |

Note:
The above data fulfill project requirements which did not call for complete separation of lead from zinc. Therefore, the above results are not the product of an optimized separation.
[1]Dithiophosphate sold by American Cyanamid Corp.
[2]Xanthate sold by Dow Chemical Corp. (iso-propyl)
[3]Ester glycol sold by American Cyanamid Corp.
Ro. = Rougher; Dist. = Distribution.

ORE B-Sample from oxidized dumps, containing about 30% pyrites, 8% sphalerite-marmatite, 1% cassiterite, 0.5% copper sulfides and siliceous gangue (Milluni Mine, La Paz, Bolivia).

The following tests were performed to separate zinc and pyrite to obtain a sulfide-free non-float fraction for subsequent tin ($SnO_2$) flotation separation.

Selective wet grinding in the presence of $Na_2S$ was performed to obtain about 80% passing 150 mesh (105μ), i.e., acceptable tin ($SnO_2$) liberation.

Reagent consumption and results appear in Table 2, below. The results show substantial separation of ore components, which had not been possible by use of conventional processes.

TABLE 2

| TEST | REAGENTS (g/ton) | | | | | | | Zn ROUGHER CONC. | | | PYRITE RO. CONC. | | | TIN FLOT. FEED | | |
|---|---|---|---|---|---|---|---|---|---|---|---|---|---|---|---|---|
| | | | | | | | | % | % | % | % | % | % | % | % | % |
| No | $Na_2S$ | NaCN | $Na_2SiO_3$ | $CuSO_4$ | Z-200[1] | A-77[2] | Z-6[3] | WT | Zn | DIST | WT | Sn | DIST | WT | Sn | DIST |
| 27 | 150 | 200 | 200 | 150 | 150 | 10 | 10 | 32.04 | 10.96 | 92.12 | 26.47 | 0.19 | 9.84 | 41.49 | 0.92 | 74.68 |
| 30 | 200 | 250 | 250 | 200 | 75 | 10 | 10 | 23.05 | 13.43 | 86.76 | 32.45 | 0.15 | 9.18 | 44.50 | 0.91 | 76.38 |
| 35 | 100 | 250 | 250 | 100 | 75 | 10 | — | 13.44 | 23.53 | 84.50 | — | — | — | 86.56 | 0.55 | 90.82 |

[1]Thionocarbamate (ethyl isopropyl thionocarbamate) sold by Dow Chemical Corporation.
[2]Ester glycol sold by American Cyanamid Corporation.
[3]Xanthate sold by Dow Chemical Corporation.

Test 35 was repeated, using in addition two upgrading (cleaner) stages and a total of 10 g/ton NaCN. The results were as follows:

| | | | | DISTRIBUTION | |
|---|---|---|---|---|---|
| PRODUCT | % WT | % Sn | % Zn | Sn | Zn |
| ZINC CONC. | 8.80 | 0.35 | 43.60 | 5.60 | 85.94 |
| ZINC MIDDS. | 10.40 | 0.25 | 2.93 | 4.73 | 6.82 |
| ZINC PRIMARY CONC. | 19.20 | 0.30 | 21.57 | 10.33 | 92.76 |
| NON-FLOAT | 80.80 | 0.61 | 0.40 | 89.67 | 7.24 |

-continued

| PRODUCT | % WT | % Sn | % Zn | DISTRIBUTION Sn | DISTRIBUTION Zn |
|---|---|---|---|---|---|
| HEADS | 100.00 | 0.55 | 4.46 | 100.00 | 100.00 |

NOTE
Flotation pH values for all above tests ranged between 6.0 and 5.5, the pH decreasing in the later stages, as expected.

A combined concentrate was obtained in this example because the current plant flowsheet would not permit sulfosalt-zinc selective separation. Thus, the present results in no way reflect on the ability of the present process to effect such selective separation. However, the ability of the present process to induce substantial recoveries is apparent.

TABLE 4

| TEST NO. | | SULFOSALTS RO. CONC. | SELECTIVE SEPARATION PRODUCT OBTAINED ZINC CONC. | ZINC MIDDS. | ZINC RO. CONC. | PYRITE RO. CONC. | NON-FLOAT | FEED |
|---|---|---|---|---|---|---|---|---|
| 2 | % WT | 3.40 | 13.97 | 8.21 | 22.18 | 17.49 | 56.92 | 100.00 |
| | % Zn | 8.61 | 45.67 | 17.50 | 35.25 | 0.35 | 0.30 | 8.34 |
| | % DIST | 3.51 | 76.48 | 17.22 | 93.70 | 0.73 | 2.05 | 100.00 |
| 3 | % WT | 4.34 | 18.59 | 10.58 | 29.17 | 16.28 | 50.20 | 100.00 |
| | % Zn | 9.22 | 38.38 | 27.05 | 34.27 | 0.25 | 0.15 | 10.51 |
| | % DIST | 3.81 | 67.86 | 27.23 | 95.09 | 0.39 | 0.72 | 100.00 |
| 4 | % WT | 6.04 | 16.35 | 5.11 | 21.46 | 16.67 | 55.83 | 100.00 |
| | % Zn | 10.38 | 48.71 | 9.97 | 39.49 | 1.22 | 0.51 | 9.59 |
| | % DIST | 6.54 | 83.07 | 5.31 | 88.38 | 2.12 | 2.96 | 100.00 |
| 5 | % WT | 5.16 | 15.49 | 6.97 | 22.46 | 16.83 | 55.54 | 100.00 |
| | % Zn | 9.42 | 49.32 | 8.05 | 36.51 | 1.87 | 0.46 | 9.26 |
| | % DIST | 5.25 | 82.52 | 6.06 | 88.58 | 3.41 | 2.76 | 100.00 |

TABLE 5

| TEST NO. | | COMBINED CONCENTRATES PRODUCT OBTAINED COMBINED CONCENTRATE | COMBINED MIDDS. | COMBINED PRIM. CONC. | PYRITE CONC. | NON-FLOAT | FEED |
|---|---|---|---|---|---|---|---|
| 8 | % WT | 16.16 | 8.66 | 24.82 | 25.30 | 49.88 | 100.00 |
| | % Zn | 49.31 | 9.13 | 35.29 | 1.64 | 0.75 | 9.55 |
| | % DIST | 83.43 | 8.30 | 91.73 | 4.35 | 3.92 | 100.00 |
| 10 | % WT | 17.50 | 6.96 | 24.46 | 22.50 | 53.04 | 100.00 |
| | % Zn | 47.80 | 6.44 | 36.03 | 0.79 | 0.45 | 9.23 |
| | % DIST | 90.64 | 4.86 | 95.50 | 1.92 | 2.58 | 100.00 |

The above project became economically more attractive due to the use of the present invention, which resulted in substantial reduction in equipment costs, as well as processing costs.

ORE C-Sample from run of mine mixed sulfides containing: 20% sphalerite-marmatite, 30% pyrites and other iron sulfides, 2% boulangerite and jamesonite (lead-silver sulfosalts), and sericitic-quartzitic gangue (Huari-Huari Mine, Potosi, Bolivia).

The testing procedure with this ore involved wet grinding in the presence of $Na_2S$ to 80% passing 150 mesh followed by selective separation of Pb/Ag sulfosalts-zinc concentrates-pyrites (TABLE 4). In subsequent tests, flotation of combined concentrate (sulfosalts and zinc) followed by flotation of pyrite, was effected. (TABLE 5).

The reagents employed are summarized in Table 3 below:

TABLE 3

| TEST No | REAGENTS (g/ton) $Na_2S$ | NaCN | Z-200 | Frother | $CuSO_4$ | Z-11 | $Na_2SiO_3$ |
|---|---|---|---|---|---|---|---|
| 2 | 100 | 180 | 50 | 20 | 300 | 50 | |
| 3 | 100 | 120 | 50 | 20 | 150 | 50 | |
| 4 | 150 | 120 | 50 | 20 | 200 | 50 | |
| 5 | 200 | 120 | 50 | 20 | 200 | 50 | |
| 8 | 125 | 150 | 50 | 20 | 300 | 50 | 50 |
| 10 | 100 | 150 | 50 | 20 | 300 | 50 | 50 |

NOTE
Flotation pH values for all above tests ranged between 6.5 and 5.5.

Based on the results oultined in TABLES 4–5 above, the system has been tested on a commercial scale in a 200 TPD processing plant located at Don Diego, Potosi (Bolivia). The flowsheet of FIG. 1 was used.

No special requirements were necessary for startup other than addition of $Na_2S$, omission of lime, and minor adjustment of the remaining reagents.

The results obtained on this commercial application after two days of continuous testing are shown in Table 6, below:

TABLE 6

| DATE | SHIFT | DAILY MILL REPORT PERCENT ZINC HEADS | CONC. | TAILS | % RECOV. |
|---|---|---|---|---|---|
| 3/26 | I | 5.69 | 48.00 | 0.50 | 92.17 |
| | II | 5.33 | 48.90 | 0.86 | 85.37 |
| | III | 5.48 | 44.38 | 1.31 | 78.41 |
| 3/27 | I | 6.09 | 47.50 | 0.65 | 90.57 |
| | II | 6.04 | 47.09 | 0.65 | 90.49 |
| | III | 6.19 | 49.50 | 1.11 | 83.95 |

NOTE
average pH values ranged between 5.8 and 6.2.

A comparison between the present invention and a conventional system in the same plant is set forth in Table 7. The figures for the "conventional lime system" represent the average of Jan. 2–Mar. 24, 1982 while the figures for the present invention represent the average of the two days' continuous run, described above. This discrepancy in statistical basis should be taken into account when the results in Table 7 are examined.

TABLE 7

COMPARISON OF REAGENT SAVINGS (ZINC AND PYRITE SECTIONS)

| REAGENT | CONVENTIONAL LIME SYSTEM g/T | Price $/kg | Cost $/T | UNMODIFIED pH PRESENT INVENTION g/T | Cost $/T |
|---|---|---|---|---|---|
| $CuSO_4$ | 720 | 0.77 | 0.554 | 400 | 0.308 |
| Z-200 | 19 | 4.79 | 0.091 | 40 | 0.192 |
| Z-11 | 100 | 1.53 | 0.153 | 60 | 0.092 |
| NaCN | 26 | 1.80 | 0.047 | 100 | 0.180 |
| Frother | 42 | 1.38 | 0.058 | 42 | 0.058 |
| Lime | 7,500 | 0.14 | 1.050 | — | — |
| $Na_2SiO_3$ | 67 | 0.37 | 0.025 | 67 | 0.025 |
| $Na_2S$ | — | 0.80 | — | 150 | 0.120 |
| TOTAL | | | 1.978 | | 0.975 |

Based on the evaluation of above results, which show substantial cost savings without sacrifice of product grades and recoveries (see Tables 8 and 10 below) the present invention has been in continuous commercial use since May, 1982 at this Potosi plant. Random daily plant data from this commercial application are set forth in Table 8, below. The last entry represents a cumulative average after 21 days' operation.

TABLE 8

DAILY MILL REPORT PERCENT ZINC

| DATE | SHIFT | HEADS | CONC. | TAILS | % RECOV. |
|---|---|---|---|---|---|
| 5/27 | I | 6.06 | 47.56 | 0.65 | 90.51 |
| | II | 5.96 | 49.96 | 0.25 | 96.29 |
| | III | 5.26 | 50.46 | 0.25 | 95.72 |
| 5/28 | I | 6.11 | 47.36 | 0.55 | 92.07 |
| | II | 6.46 | 46.76 | 0.50 | 93.26 |
| | III | 6.46 | 44.76 | 0.25 | 96.67 |
| 6/03 | I | 6.56 | 48.43 | 0.57 | 92.40 |
| | II | 5.99 | 50.80 | 0.41 | 93.91 |
| | III | 5.63 | 48.95 | 1.14 | 81.65 |
| 6/21 | I-III | 7.06 | 49.23 | 0.93 | 88.50 |
| JUNE CUMULATIVE AVERAGE (1-21) | | 6.42 | 47.11 | 0.72 | 90.16 |

The observed variations in reagent consumption were expected as incident to start-up. They were due to factors independent of the present invention, especially the operators' lack of acquaintance with the new procedures. For this reason, the recent average reagent consumption, set forth in Table 9 below, is a more meaningful parameter. Consumption of $Na_2S$ shows a reduction of 56% in Table 9 compared to Table 7. In addition, system optimization reduces consumption of the other reagents.

As close monitoring of pH values is no longer necessary in plant operation, pH measuring equipment and facilities may be eliminated from plants using the present invention.

TABLE 9

CURRENT REAGENT DATA - AVERAGE JUNE, 1982 (ZINC AND PYRITE SECTIONS)

| REAGENT | g/ton | COST $/ton |
|---|---|---|
| $CuSO_4$ | 563 | 0.434 |
| Z-200 | 44 | 0.211 |
| Z-11 | 66 | 0.101 |
| NaCN | 102 | 0.184 |
| Frother | 66 | 0.091 |
| $Na_2SiO_3$ | 40 | 0.015 |
| $Na_2S$ | 66 | 0.053 |
| TOTAL | | 1.088 |

Updated data for the above plant based on commercial operation from June to October 1982 and comparing performance of the circuit utilizing the present process to that of the conventional (lime) circuit ore set forth in Table 10 below:

TABLE 10

| Month | Tonnes | Heads | % Zn Conct. | Tails | % Recovery |
|---|---|---|---|---|---|
| Lime Circuit | | | | | |
| Jan. 1982 | 4456 | 6.76 | 50.37 | 1.19 | 84.40 |
| Feb. | 2494 | 9.44 | 49.98 | 1.27 | 88.80 |
| Mar. | 3427 | 7.07 | 47.40 | 1.17 | 85.56 |
| Apr. | 3723 | 6.11 | 48.96 | 1.43 | 78.90 |
| May | 3127 | 6.52 | 47.06 | 1.39 | 81.07 |
| Avg. | 3445 | 7.03 | 48.82 | 1.29 | 83.87 |
| No-Lime Circuit | | | | | |
| Jun. | 3035 | 6.51 | 47.36 | 0.77 | 89.67 |
| Jul. | 3137 | 7.08 | 45.94 | 0.77 | 90.63 |
| Aug. | 3694 | 6.93 | 47.50 | 0.68 | 91.50 |
| Sep. | 2957 | 7.43 | 48.86 | 0.76 | 91.20 |
| Oct. | 3609 | 6.82 | 49.89 | 0.77 | 90.10 |
| Avg. | 3286 | 6.95 | 47.91 | 0.75 | 90.74 |

ORE D. Sample of run of mine, mixed sulfides containing: 20% sphalerite, 3% galena (6 oz Ag per ton), 40% pyrite and siliceous gangue. Liberation size (Zn) is about 80% passing 100 mesh (Porco Mine, Potosi, Bolivia).

Differential flotation effects (Pb−Zn) were observed during preliminary testing. However (as in the case of "Ore C", above), such separation was not sought, due to lack of required equipment in the plant.

Combined concentrates (Pb+Ag+Zn) were floated from pyrites and gangue, at unmodified pH of 6.5 under the conditions summarized in Table 11, below and with the results set forth therein.

TABLE 11

BATCH FLOTATION TESTS

| TEST NO. | PRODUCT | % WT | % Zn | % DIST | REAGENTS (g/ton) $Na_2S$ | NaCN | $CuSO_4$ |
|---|---|---|---|---|---|---|---|
| 1 | Zn Ro. Conc. | 21.00 | 31.63 | 61.49 | 100 | 150 | 250 |
| | Zn Sc. Conc. | 36.24 | 10.95 | 36.73 | | | |
| | Zn Prim. Conc. | 56.24 | 18.87 | 98.22 | | | |
| | Non-float | 42.76 | 0.45 | 1.78 | | | |
| | Heads | 100.00 | 10.61 | 100.00 | | | |
| 2 | Zn Ro Conc. | 26.75 | 33.34 | 83.40 | 50 | 100 | 250 |
| | Zn Sc. Conc. | 26.65 | 5.70 | 14.20 | | | |
| | Zn Prim. Conc. | 53.40 | 19.54 | 97.60 | | | |
| | Non-float | 46.60 | 0.55 | 2.40 | | | |
| | Heads | 100.00 | 10.69 | 100.00 | | | |
| 3 | Zn Prim. Conc. | 32.37 | 29.76 | 86.62 | 50 | 125 | 225 |
| | Non-float | 67.63 | 2.20 | 13.38 | | | |
| | Heads | 100.00 | 11.12 | 100.00 | | | |

TABLE 11-continued

| TEST NO. | PRODUCT | BATCH FLOTATION TESTS % WT | % Zn | % DIST | REAGENTS (g/ton) $Na_2S$ | NaCN | $CuSO_4$ |
|---|---|---|---|---|---|---|---|
| 4 | Zn Ro Conc. | 23.14 | 27.79 | 59.28 | 75 | 125 | 250 |
| | Zn Sc. Conc. | 18.74 | 18.92 | 32.68 | | | |
| | Zn Prim. Conc. | 41.88 | 23.82 | 91.96 | | | |
| | Non-float | 58.12 | 1.50 | 8.04 | | | |
| | Heads | 100.00 | 10.85 | 100.00 | | | |

The collector was Z-200 and the frother was "Dowfroth 250", a polyglycol ether (polyproylene ether) sold under this trademark by the Dow Chemical Corporation. Consumption of each was 40 g/ton.

Conditioning and flotation times were 5 and 10 minutes per stage, respectively.

No upgrading tests were performed.

ORE E-An unknown mixed sulfides sample from Mexico was tested at Mountain States Laboratories (Tucson, Ariz.) in February, 1982.

The sample contained about: 2% Pb, 2 oz/ton Ag, 3% Zn, and 10% Fe.

The preliminary test conditions and results are outlined in Table 13, below:

TABLE 13

TEST CONDITIONS AND RESULTS

GRIND: 80% passing 100 mesh

FLOTATION pH = 8.5 (due to ore composition and water condition at testing facility).

| REAGENTS (g/ton): | | | | |
|---|---|---|---|---|
| | $Na_2S$ | 100 | $CuSO_4$ | 200 |
| | NaCN | 150 | Z-200 | 40 |
| | $Na_2SiO_3$ | 100 | D-250 | 20 |

Conditioning and flotation times were 5 min. and 10 min. per stage, respectively.

| PRODUCT | % WT | % Pb | oz/ton Ag | % Zn | % DISTRIBUTION Pb | Ag | Zn |
|---|---|---|---|---|---|---|---|
| Pb—Ag Ro. Conc. | 7.46 | 26.60 | 24.53 | 6.6 | 97.97 | 80.89 | 14.83 |
| Zn Ro Conc. | 15.60 | 0.14 | 1.75 | 18.0 | 1.08 | 12.07 | 84.59 |
| Pyrite Ro. Conc. | 2.84 | 0.16 | 1.17 | 0.16 | 0.22 | 1.47 | 0.14 |
| Non-float | 74.10 | 0.02 | 0.17 | 0.02 | 0.73 | 5.57 | 0.44 |
| HEADS | 100.00 | 2.02 | 2.26 | 3.32 | 100.00 | 100.00 | 100.00 |

The above results, which show substantial flotation selectivity and recoveries at optimum or near optimum $Na_2S$, NaCN and $CuSO_4$ concentrations, formed the basis for a plant testing program at 400 TPD, during 5 days, with the following results:

TABLE 12

PLANT TESTING - CONDITIONS AND RESULTS (Flowsheet as per FIG. 1)

| | TEST NO. 1 | 2 | 3 | 4 | 5 | LIME SYSTEM |
|---|---|---|---|---|---|---|
| | CONSUMPTION (g/ton) | | | | | |
| REAGENT | | | | | | |
| $Na_2S$ | 50 | 55 | 55 | 85 | 60 | — |
| Z-200 | 50 | 50 | 70 | 70 | 70 | 38 |
| NaCN | 75 | 50 | 70 | 50 | 60 | 3 |
| $CuSO_4$ | 300 | 420 | 270 | 360 | 360 | 672 |
| D-250 | 45 | 15 | 15 | 15 | 15 | 36 |
| Z-11 | | | | | | 85 |
| LIME | | | | | | 11,086 |
| PRODUCTS (% Zn) | | | | | | |
| HEADS | 9.64 | 9.74 | 9.84 | 10.44 | 12.11 | 10.39 |
| CONCENTR. | 48.99 | 51.65 | 53.63 | 50.16 | 54.19 | 53.08 |
| TAILS | 2.15 | 2.10 | 3.10 | 2.97 | 1.00 | 1.26 |
| RECOVERY (%) | 81.26 | 81.76 | 72.70 | 76.05 | 93.47 | 91.56 |

For comparison purposes, the last column shows plant data obtained under the conventional (lime) system during March, 1982 (monthly average).

In evaluating the above results, the fact that this was a "blind test" is entitled to substantial weight.

The above results may be used to estimate those of an industrial scale application in regular operation, by extrapolation. Further laboratory testing could be done to further reduce the amount of pyrite collected with the zinc rougher concentrate. The above results indicate excessive activation by $CuSO_4$, which may be controlled by exercise of ordinary skill in the art.

ORE F: Sample from run of mine mixed sulfides containing approximately 0.18% Pb, 8.4% Zn and 10–12% $FeS_2$ by weight.

The testing procedure involved wet grinding to 85% passing 65 mesh. The reagents used, testing procedure and results are summarized in Tables 14–17, below, and show substantial recoveries and selectivity.

TABLE 14

| PRODUCT | Weight % | % Pb | % Zn | % Distribution Pb | Zn |
|---|---|---|---|---|---|
| Pb Ro Con (1) | 4.65 | 2.63 | 2.28 | 69.29 | 1.26 |
| Zn Ro Con (2) | 10.40 | .10 | 61.37 | 5.89 | 75.93 |
| Zn $Sc_1$ Con (3) | 2.90 | .13 | 48.28 | 2.14 | 16.68 |
| Zn PRIM Con (1-3) | .12 | 46.83 | 11.33 | 95.76 | |
| 17.19 | | | | | |
| Zn $Sc_2$ Con | 3.89 | .15 | 6.82 | 3.30 | 3.15 |
| $FeS_2$ Ro Con | 9.93 | .07 | .73 | 3.94 | .86 |
| NON-FLOAT | 68.23 | .04 | .26 | 15.45 | 2.11 |
| HEADS | 100.00 | .176 | 8.40 | 100.00 | 100.00 |

| STAGE | Time (Min.) | pH | REAGENTS (G/T) |
|---|---|---|---|
| Grind | 8 | 7.65 | 50 g/ton $Na_2S$ |
| Cond. I | 5 | — | 50 g/ton NaCN |
| Pb Cond./Flot. | 5/5 | — | 20 g/ton A-242, 15 g/ton |

TABLE 14-continued

| | | | |
|---|---|---|---|
| | | | frother |
| Cond. II | 4 | 7.5 | 150 g/ton $CuSO_4$ |
| Zn Rougher Cond. Flot. | 5/2 | | 30 g/ton Z-14 |
| Zn $SC_1$ Flot. | 3 | — | — |
| Zn $SC_2$ Flot. | 5 | — | — |
| $FeS_2$ Rougher Cond/Flot. | 3/5 | 7.8 | 15 g/ton frother, 50 g/ton Z-6 (amyl xanthate) |

Sc. = Scavenger

TABLE 15

| PRODUCT | Weight % | % Pb | % Zn | % Distribution Pb | % Distribution Zn |
|---|---|---|---|---|---|
| Pb Ro Conc. | 4.71 | 2.55 | 2.43 | 71.43 | 1.26 |
| Zn Ro Conc. (1) | 12.43 | .10 | 59.15 | 7.39 | 87.54 |
| Zn Sc. Conc. (2) | 1.93 | .21 | 25.18 | 2.41 | 5.79 |
| Zn Prim. Conc (1-2) | 14.36 | .11 | 54.60 | 9.80 | 93.33 |
| $FeS_2$ Ro Conc. | 12.19 | .09 | 1.46 | 6.52 | 2.12 |
| NON-FLOAT | 68.73 | .03 | .39 | 12.25 | 3.19 |
| HEADS | 100.00 | .168 | 8.40 | 100.00 | 100.00 |

| STAGE | Time (Min.) | pH | REAGENTS (GR/MT) |
|---|---|---|---|
| Grind | 8 | 7.85 | 75 g/ton $Na_2S$ |
| Cond. I | 5 | — | 75 g/ton NaCN |
| Pb Cond./Flot. | 5/5 | — | 15 g/ton A-242, 15 g/ton frother |
| Cond. II | 4 | 7.5 | 200 g/ton $CuSO_4$ |
| Zn Rougher Cond. Flot. | 5/2 | | 30 g/ton Z-14 |
| Zn Sc. Flot. | 3 | — | — |
| $FeS_2$ Rougher Cond/Flot. | 3/5 | — | 15 g/ton frother, 50 g/ton Z-6 |

TABLE 16

| PRODUCT | Weight % | % Pb | % Zn | % Distribution Pb | % Distribution Zn |
|---|---|---|---|---|---|
| Pb Ro Conc. | 4.28 | 2.82 | 2.03 | 69.52 | 1.03 |
| Zn Ro Conc. | 14.58 | .10 | 51.67 | 8.39 | 89.59 |
| Zn Sc Conc. | 3.12 | .13 | 12.52 | 2.33 | 4.64 |
| Zn Prim. Conc. | 17.70 | .11 | 44.77 | 10.72 | 94.23 |
| $FeS_2$ Ro Conc. | 7.84 | .08 | 1.50 | 3.61 | 1.40 |
| NON-FLOAT | 70.17 | .04 | .40 | 16.15 | 3.34 |
| HEADS | 100.00 | .174 | 8.41 | 100.00 | 100.00 |

| STAGE | Time | pH | REAGENTS (GR/MT) |
|---|---|---|---|
| Grind | 8' | — | |
| Cond. I | 5' | — | 100 g/ton $Na_2S$ |
| Cond. II | 5' | — | 100 g/ton NaCN |
| Pb Cond./Flot. | 5'/5' | — | 20 g/ton A-242, 15 g/ton frother |
| Cond. III | 5' | 7.5 | 200 g/ton $CuSO_4$ |
| Zn Rougher Cond./Flot. | 5'/2' | — | (15 g/ton frother), 50 g/ton Z-14 |
| Zn Sc. Flot. | 3' | — | — |
| $FeS_2$ Ro Cond/Flot. | 3'/5' | — | 15 g/ton frother, 50 g/ton Z-6 |

TABLE 17

| PRODUCT | Weight % | % Pb | % Zn | % Distribution Pb | % Distribution Zn |
|---|---|---|---|---|---|
| Pb Ro Conc. | 5.61 | 2.48 | 3.05 | 72.03 | 2.14 |
| Zn Ro Conc. | 12.87 | .07 | 55.38 | 4.67 | 89.40 |
| Zn Sc Conc. | 4.23 | .20 | 2.88 | 4.38 | 1.53 |
| Zn Prim. Conc. | 17.10 | .10 | 42.40 | 9.05 | 90.93 |
| $FeS_2$ Ro. Conc. | 9.36 | .10 | 4.09 | 4.85 | 4.80 |
| NON-FLOAT | 67.94 | .04 | .25 | 14.08 | 2.13 |
| HEADS | 100.00 | .193 | 7.97 | 100.00 | 100.00 |

| STAGE | Time (Min.) | pH | REAGENTS (GR/MT) |
|---|---|---|---|
| Grind | 8 | — | 100 g/ton $Na_2S$ |
| Pb Cond./Flot. | 5/5 | 7.5 | 20 g/ton A-242, 15 g/ton frother |

TABLE 17-continued

| | | | |
|---|---|---|---|
| Condit. | 3 | 10.9 | 1330 g/ton LIME |
| Zn Rougher Cond./Flot. | 5/2 | 10.7 | (15 g/ton frother) 465 g/ton $CuSO_4$, 50 g/ton Z-14 |
| Zn Sc. Flot. | 3 | — | 7.5 g/ton frother |
| $FeS_2$ Ro Cond/Flot. | 3/5 | — | 15 g/ton frother, 50 g/ton Z-6 |

Table 17 presents test results obtained with use of lime and is set forth above for comparison purposes.

ORE G: Zinc Dumps processed at Don Diego, Potosi, Bolivia containing 35% sphalerite and 20% pyrite. Treated in accordance with FIG. 1. The natural ore pH was 5.5.

TABLE 18

| | | Weight (Tons) | % Zn | % Dist. Zn |
|---|---|---|---|---|
| Day 1 | Feed | 143.65 | 18.02 | 100.00 |
| | Conct. | 40.65 | 56.57 | 88.85 |
| | Tail | 103.00 | 2.80 | 11.15 |
| Day 2 | Feed | 114.88 | 18.40 | 100.00 |
| | Conct. | 34.54 | 56.09 | 91.67 |
| | Tail | 80.34 | 2.19 | 8.33 |
| Day 3 | Feed | 95.71 | 18.79 | 100.00 |
| | Conct. | 31.74 | 53.73 | 94.81 |
| | Tail | 63.97 | 1.46 | 5.19 |

Reagent Consumption:

$Na_2S$ 75 g/t; NaCN 149 g/t; $CuSO_4$ 1088 g/t; Z-200 75 g/t; Z-6 103 g/t; Frothers 34 g/t The particular applications of the present invention to concentration of Cu-Mo are further illustrated by the following additional examples:

ORE H: Sample consisting of pyrite, molybdenite, chalcopyrite and chalcocite finely dispersed in quartz monzonite porphyry.

Run of mine ore was ground to 80%-100 mesh* (Tyler) during all tests following operating plant procedures. The first two test (results and conditions set forth in Tables 18-19) involved induced flotation in accordance with FIG. 2, one without lime, one with lime. The last two tests (results and conditions set forth in Tables 20-22) involved collectorless flotation according to FIG. 3 using a combination of $Na_2S$ and NaCN. Collectorless flotation using the present invention gave a Mo rougher concentrate of a better grade. Finally, Table 23 summarizes collectorless flotation without use of NaCN (for comparison purposes). Table 23 shows better Mo-Cu separation but poorer Cu-pyrite separation.

*At the given grind size, liberation of only 80% of each Cu and Mo was obtained.

TABLE 18

| PRODUCT | Weight % | Analysis % Mo | Analysis % Cu | % Distribution Mo | % Distribution Cu |
|---|---|---|---|---|---|
| Moly Ro. Conc. | 2.37 | 5.00 | 3.89 | 80.22 | 60.70 |
| Copper Ro. Conc. | 2.08 | .42 | .79 | 5.91 | 10.82 |
| Pyrite Ro. Conc. | 1.63 | .45 | .81 | 4.97 | 8.69 |
| Non-Float | 93.92 | .014 | .032 | 8.90 | 19.79 |
| Heads | 100.00 | .152 | .148 | 100.00 | 100.00 |

| STAGE | Time (Min.) | pH | REAGENTS (g/ton) |
|---|---|---|---|
| Grind | 5.5 | — | 50 $Na_2S$, 100 Moly-Copper Collector, |
| Cond. I | 5 | 7.3 | |
| Mo. Ro. Flot. | 5 | 7.9 | 100 $Na_2SiO_3$, 75 NaCN, 15 frother (MIBC) |
| Cu. Ro. (Cond./Flot.) | 5/5 | | 7.5 frother (MIBC), 5 (1331)** |

TABLE 18-continued

| | | |
|---|---|---|
| Pyrite Ro. (Cond./Flot) | 3/5 | 7.5 frother (MIBC) 50 (Z-6) |

**MINEREC 1331 (copper collector).

TABLE 19

| PRODUCT | Weight % | Analysis % Mo | Analysis % Cu | % Distribution Mo | % Distribution Cu |
|---|---|---|---|---|---|
| Mo—Cu Ro. Conc. | 2.9 | 3.73 | 2.85 | 78.64 | 56.05 |
| Mo—Cu Scav. Conc | 1.09 | 1.12 | .77 | 8.84 | 5.67 |
| Non-Float | 96.00 | .018 | .059 | 12.52 | 38.28 |
| Heads | 100.00 | .138 | .148 | 100.00 | 100.00 |

| STAGE | Time (Min.) | pH | REAGENTS (g/ton) |
|---|---|---|---|
| Grind | 5.5 | 9.5 | 1000 (Lime), 100 MCO Collector* |
| Cond. I | 5 | 10.7 | 500 (Lime) 5 (1331) 7.5 (MIBC) |
| Mo—Cu Ro Flot. | 5 | | |
| Mo—Cu Scav. Flot. | 5 | | |

*Mo-Cu Collector (Phillips 66 Co.)

TABLE 20

| PRODUCT | Weight % | Analysis % Mo | Analysis % Cu | % Distribution Mo | % Distribution Cu |
|---|---|---|---|---|---|
| Mo Ro. Conc | 1.48 | 3.52 | 2.63 | 54.36 | 30.47 |
| Mo. Scav. Conc. | 1.00 | .98 | 1.92 | 10.25 | 15.07 |
| Cu Ro. Conc. | 1.50 | .46 | 1.79 | 7.20 | 20.54 |
| Cu Scav. Conc. | 1.07 | .38 | .62 | 4.25 | 5.2 |
| $FeS_2$ Ro Conc | 2.15 | .16 | .54 | 3.59 | 9.1 |
| Non-Float | 92.80 | .021 | .027 | 20.35 | 19.63 |
| Heads | 100.00 | .096 | .128 | 100.00 | 100.00 |

| STAGE | Time | pH | REAGENTS (g/ton) |
|---|---|---|---|
| Grind | 5.5 | 7.9 | 50 ($Na_2S$) |
| Cond. I | 3 | | 50 ($Na_2S$) |
| Cond. II | 3 | | 25 (NaCN), 15 (frother) |
| Mo. Ro. Flot. | 5 | | |
| Mo. Scav. Flot. | 5/5 | | 7.5 (frother), 10 (fuel oil) |
| Cu Ro. Cond. Flot. | 3/5 | | 15 (frother), 5 (Z-14) |
| Cu Scav. Cond. Flot. | 3/5 | | 7.5 (frother), 5 (Z-14) |
| Pyrite Ro Flot | 3/5 | | 15 (frother, 25 (Z-6) |

TABLE 21

| PRODUCT | Weight % | Analysis % Mo | Analysis % Cu | % Distribution Mo | % Distribution Cu |
|---|---|---|---|---|---|
| Mo. Ro. Conc. | 2.24 | 3.47 | 2.30 | 69.05 | 42.53 |
| Mo. Scav. Conc. | .89 | .93 | .86 | 7.34 | 6.30 |
| Cu Ro. Conc. | 2.59 | .21 | 1.28 | 4.82 | 27.32 |
| Pyrite Ro. Conc. | .89 | .28 | .31 | 2.21 | 2.27 |
| Non-Float | 93.40 | .02 | .028 | 16.59 | 21.58 |
| Heads | 100.00 | .113 | .121 | 100.00 | 100.00 |

| STAGE | Time | pH | REAGENTS (g/ton) |
|---|---|---|---|
| Grind | 5.5 | 8.1 | 150 ($Na_2S$) |
| Cond. I | 3 | | 50 ($Na_2S$) |
| Cond. II | 3 | | 25 (NaCN) |
| Mo. Ro. Flot. | 5 | | |
| Mo. Scav. Flot. | 5/5 | | 7.5 (frother), 10 (fuel oil) |
| Copper Ro. Cond. Flot. | 3/5 | | 15 (frother), 10 (Z-14) |
| Pyrite Ro. Cond. Flot. | 3/5 | | 15 (frother), 25 (Z-6) |

TABLE 22

| PRODUCT | Weight % | Analysis % Mo | Analysis % Cu | % Distribution Mo | % Distribution Cu |
|---|---|---|---|---|---|
| Mo. Ro. Conc. | 1.65 | 3.66 | 2.12 | 59.41 | 27.96 |
| Mo. Scav. Conc. | .89 | .99 | 2.20 | 8.61 | 15.55 |
| Copper Ro. Conc. | 1.36 | .48 | 1.74 | 6.40 | 18.86 |
| Copper Sc. Conc. | .54 | .46 | .83 | 2.44 | 3.59 |
| Pyrite Ro. Conc. | 2.36 | .13 | .70 | 3.01 | 13.20 |

TABLE 22-continued

| | | | | | |
|---|---|---|---|---|---|
| Non-Float | 93.20 | .022 | .028 | 20.13 | 20.83 |
| Heads | 100.00 | .102 | .125 | 100.00 | 100.00 |

| STAGE | Time (Min.) | pH | REAGENTS (g/ton) |
|---|---|---|---|
| Grind | 5.5 | 7.9 | 75 ($Na_2S$) |
| Cond. I | 3 | | 25 ($Na_2S$) |
| Cond. II | 3 | | 25 (NaCN), 15 (frother) |
| Mo. Ro. Flot. | 5 | | |
| Mo. Scav. Cond. Flot. | 5/5 | | 7.5 (frother), 10 (fuel oil) |
| Copper Ro. Cond. Flot. | 3/5 | | 15 (frother), 5 (Z-14) |
| Copper Sc. Cond. Flot. | 3/5 | | 7.5 (frother), 5 (Z-14) |
| Pyrite Ro. Cond. Flot. | 3/5 | | 15 (frother), 25 (Z-6) |

TABLE 23

| PRODUCT | Weight % | Analysis % Mo | Analysis % Cu | % Distribution Mo | % Distribution Cu |
|---|---|---|---|---|---|
| Mo Rougher Conc. | .98 | 9.25 | .64 | 72.65 | 6.00 |
| Mo. Scav. Conc. | .55 | 1.46 | .65 | 6.47 | 3.47 |
| Copper Ro. Conc. | .69 | .32 | 1.45 | 1.76 | 9.56 |
| Copper Sc. Conc. | 1.10 | .42 | .82 | 3.71 | 8.67 |
| Pyrite Ro. Conc. | 2.04 | .11 | 2.22 | 1.79 | 43.34 |
| Non-Float | 94.63 | .018 | .032 | 13.61 | 28.97 |
| Heads | 100.00 | .125 | .105 | 100.00 | 100.00 |

| STAGE | Time (Min.) | pH | REAGENTS (g/ton) |
|---|---|---|---|
| 10 × Grind | 5.5 | | 60 ($Na_2S$) |
| Cond. I | 3 | | 20 ($Na_2S$), 7.5 (frother) |
| Mo. Ro. Flot | 7.5 | 7.4 | |
| Mo. Scav. Cond. Flot. | 5/7.5 | | 2.5 (frother), 7 (fuel oil) |
| Copper Ro. Cond. Flot. | 3/10 | | 5 (Z-14) |
| Copper Sc. Cond. Flot. | 3/5 | | 2.5 (frother), 2 (Z-14) |
| Pyrite Ro. Cond. Flot. | 3/5 | | 30 (Z-6) |

Theoretical Calculation

In a typical concentration of Cu-Mo containing ore in accordance with the prior art treating 20,000 tpd of 0.7% Cu and 0.015% Mo, primary flotation will produce 476 tpd of a bulk Cu-Mo concentrate assaying 25% Cu and 0.536% Mo, representing a Mo recovery of 85%. A primary flotation process in accordance with FIG. 3, with the same recovery would only have to produce 85 tpd of a molybdenite float assaying 3% Mo and 3% Cu. In addition, this 85 tpd would be essentially collector-free, thus eliminating the need for collector removal or transformation.

What is claimed is:

1. A process for the separation for the mineral components of an ore, said ore comprising base metal sulfides including pyrite, by sequential flotation, said process comprising in sequence:

(a) grinding said ore to form ore pulp and mixing said pulp with sulfide ions and cyanide ions at amounts:

(i) sufficient to depress pyrite and to inhibit flotation of all the other base metal sulfides contained in said ore except the sulfides of the metal which will be floated first, but (ii) insufficient to cause overdepression of said other base metal sulfides; said ions having been introduced into said pulp at predetermined times in a predetermined sequence prior to flotation;

said sulfide ion amounts ranging between about 8 and about 82 g/ton of ore and said cyanide ion concentration ranging between about 11 and about 110 g/ton of ore;

(b) adding a collector, for the sulfides of the metal which were not inhibited in said step (a)(i); to said ion-containing pulp and (c) floating the sulfides of the metal which were not inhibited in said step (a)(i); wherein said process takes place at a pH essentially determined by the ore composition and the quality of the water used to form said pulp, said pH, as so determined, ranging between about 5.5 and about 8.5, without addition of substantial amounts of alkaline or acid pH modifiers, sufficient to change the pH.

2. The process of claim 1, wherein said sulfide ions are introduced during grinding of said ore, said grinding being wet grinding.

3. The process of claim 2, wherein said cyanide ions are introduced into said pulp subsequent to the introduction of said sulfide ions.

4. The process of claim 3, wherein said cyanide ions are introduced into said pulp in a conditioning operation following said wet grinding.

5. The process of claim 1, said process taking place at a pH determined by the ore composition and the quality of the water used to form said pulp without any addition of alkaline pH modifiers.

6. The process of claim 4, wherein said ore is a Cu-Mo ore, the process further comprising subsequent conditioning of said pulp with a copper collector and frother followed by flotation of a Cu-Mo concentrate.

7. The process of claim 6 wherein said sulfide ion is provided by a member selected from the group consisting of $Na_2S$, $K_2S$ and NaHS.

8. The process of claim 7 wherein said cyanide ion is provided by a member selected from the group consisting of NaCN, KCN and $Ca(CN)_2$.

9. The process of claim 7 wherein said sulfide ion is provided by $Na_2S$.

10. The process of claim 9 wherein said cyanide ion is provided by NaCN.

11. The process of claim 9 wherein said $Na_2S$ consumption ranges between about 20 and 50 g/ton.

12. The process of claim 10 wherein said NaCN consumption ranges between about 25 and 100 g/ton.

13. The process of any one of claims 2–4 and claim 1, said process taking place at a pH determined by the ore composition and the quality of the water used to form said pulp without addition of alkaline pH modifiers.

14. The process of any one of claims 2–4 and claim 1 wherein said ore is a complex base metal mixed sulfide ore containing at least two of the metals Pb, Cu, Ag, Zn, Fe, the process further comprising subsequent conditioning of said pulp with collectors and frothers followed by direct selective flotation of the valuable mineral constituents of said ore in the order of: Pb-[Ag]-:Cu:Zn:Fe.

15. The process of claim 14 said process taking place at a pH determined by the ore composition and the quality of the water used to form said pulp without any addition of alkaline pH modifiers.

16. The process of claim 14, wherein said sulfide ion is provided by a member selected from the group consisting of $Na_2S$, $K_2S$ and NaHS.

17. The process of claim 16, wherein said cyanide ion is provided by a member selected from the group consisting of NaCN, KCN and $Ca(CN)_2$.

18. The process of claim 17 wherein said sulfide ion is provided by $Na_2S$.

19. The process of claim 18 wherein said cyanide ion is provided by NaCN.

20. The process of claim 18 or 19 wherein said $Na_2S$ consumption ranges between about 20 and 200 g/ton.

21. The process of claim 20 wherein said NaCN consumption ranges between about 25 and 200 g/ton.

22. A process for the separation of the mineral components of an ore, said ore comprising base metal sulfides including pyrite, by sequential flotation, said process comprising in sequence:

(a) grinding said ore to form ore pulp and mixing said pulp and sulfide ions and cyanide ions at amounts:

(i) sufficient to depress pyrite and to inhibit flotation of all the other base metal sulfides contained in said ore except the sulfides of the metal which will be floated first, but (ii) insufficient to cause overdepression of said base metal sulfides; said ions having been introduced into said pulp at predetermined times in a predetermined sequence prior to flotation; and (iii) effective in combination to accomplish at least one of the following: reduction of quantities of reagents used in said flotation, improvement of flotation selectivity, improvement of concentrate grades, and reduction of conditioning and residence times;

(b) adding a collector, for the sulfides of the metal which were not inhibited in said step (a)(i), to said ion containing pulp; and (c) floating the sulfides of the metal which were not inhibited in said step (a)(i);

wherein, said sulfide ion amount ranges between about 8 and about 82 g/ton of ore and said cyanide ion amount ranges between about 11 and about 110 g/ton of ore and said process takes place at a pH essentially determined by the ore composition and the quality of the water used to form said pulp, said pH, as so determined, ranging between about 5.5 and about 8.5, without addition of substantial amounts of alkaline or acid pH modifiers, sufficient to modify the pH.

* * * * *